United States Patent [19]

Sornberger

[11] 4,173,359

[45] Nov. 6, 1979

[54] INTERLOCKED CONTINUOUS WEBS

[75] Inventor: G. Russell Sornberger, Sanborn, N.Y.

[73] Assignee: Moore Business Forms, Inc., Grand Island, N.Y.

[21] Appl. No.: 891,842

[22] Filed: Mar. 30, 1978

Related U.S. Application Data

[63] Continuation of Ser. No. 768,189, Feb. 14, 1977, abandoned.

[51] Int. Cl.[2] ..... B31F 1/00; B42D 5/00

[52] U.S. Cl. ..... 282/11.5 A; 282/21 C

[58] Field of Search ..... 282/11.5 A, 11.5 R, 282/12 A, 20 R, 20 B, 21 C, 21 R, 21 D

[56] References Cited

U.S. PATENT DOCUMENTS

| | | | |
|---|---|---|---|
| 2,246,065 | 6/1941 | Ritzhaupt | 282/11.5 A |
| 2,935,002 | 5/1960 | Robinson, Jr. | 282/11.5 A X |
| 3,223,437 | 12/1965 | Bertsch | 282/11.5 A |
| 3,475,249 | 10/1969 | Smith, Jr. | 282/11.5 A |
| 3,517,589 | 6/1970 | Herd et al. | 282/11.5 A |

FOREIGN PATENT DOCUMENTS

| | | | |
|---|---|---|---|
| 2419852 | 11/1975 | Fed. Rep. of Germany | 282/11.5 A |
| 6504514 | 10/1965 | Netherlands | 282/11.5 A |
| 1058635 | 2/1967 | United Kingdom | 282/11.5 A |

*Primary Examiner*—Robert L. Spicer, Jr.
*Attorney, Agent, or Firm*—Lawrence R. Radanovic

[57] ABSTRACT

Continuous superimposed webs are interlocked together along opposite marginal edges by sets of superimposed tongues provided in the webs which interengage to effect an interlock. Each set includes at least a pair of superimposed tongues disposed along a line forming an angle with an adjacent marginal edge so that one of the tongues is staggered relative to the other in the direction of feed of the webs through a web processing machine. Thus, during separation of the plies in the direction of feed the forwardmost superimposed tongues are separated before the rearwardmost tongues thereby avoiding simultaneous separation of the tongues and decreasing the resistance offered by the tongues upon ply separation.

2 Claims, 6 Drawing Figures

INTERLOCKED CONTINUOUS WEBS

This is a continuation of application Ser. No. 768,189 filed Feb. 14, 1977, now abandoned.

BACKGROUND OF THE INVENTION

This invention relates generally to interlocked continuous webs, and more particularly to the provision of sets of inter-engaging tongues staggered along at least a marginal edge of the webs for interlocking them together and for facilitating an easier separation of the plies.

For the purpose of releasably interlocking continuous super-imposed webs together, interengaging superimposed tongues have been provided in such webs for preventing both longitudinal and transverse relative shifting of the webs while at the same time permitting the webs to be separated or peeled apart during decollating. Such tongues may be spaced along one or both marginal edges of the webs and are provided by punching or slitting through the webs to form substantially U-cuts forming tongues integrally attached to the webs and having free ends and side edges provided by the deviating slits. The tongues may likewise be formed by substantially H-shaped cuts.

At each spaced location along the marginal edge or edges, one or more of such superimposed tongues may be provided depending on the holding strength required for the number of webs to be interlocked together. However, where more than one of such superimposed tongues are present at each spaced location, they typically lie along a line perpendicular to their adjacent marginal edge. Consequently, when such webs are peeled apart during a web decollating operation, the interengaging tongues between webs at each location along the marginal edges unlock or disengage simultaneously as the webs of the assembly are decollated. Hence, the decollating operation is not smooth by reason of a "tug" or a "snag" experienced each time a set of the laterally disposed sets of tongues are peeled apart. In other words, the resistance offered by the two or more interengaging tongues at the spaced locations along the marginal edges is sufficiently great as to affect the smooth decollating operation of the webs.

SUMMARY OF THE INVENTION

Interlocking tongues are disposed for securing together a plurality of superimposed webs of a continuous web assembly in such a manner that during decollating the strong resistance offered by a plurality of such tongues at spaced locations along the marginal edges is avoided without affecting the holding power offered by such plurality of tongues in maintaining the webs effectively secured together. This is accomplished by staggering superimposed tongues in each spaced set so that adjacent tongues of each set lie forwardly of one another in the direction of feed of the assembly through a web processing machine. The superimposed interlocking tongues of each set lie along lines disposed at angles to their adjacent marginal edge so that only a single one of the tongues of each set will disengage during the web decollating operation, with such disengagement occurring before the next adjacent tongues disengage. The interlocking tongues thus behave similarly as single tongues at each spaced location since the set of a plurality of tongues is staggered relative to one another. A smooth decollating operation is therefore assured for the webs.

BRIEF DESCRIPTION OF THE DRAWINGS

FIGS. *3a*, *3b* and *3c* are sectional views taken substantially along line 3—3 of FIG. 2 showing the sequential disengagement of the locking tongues of a typical set during a web decollating operation.

DETAILED DESCRIPTION OF THE INVENTION

Figure 1:
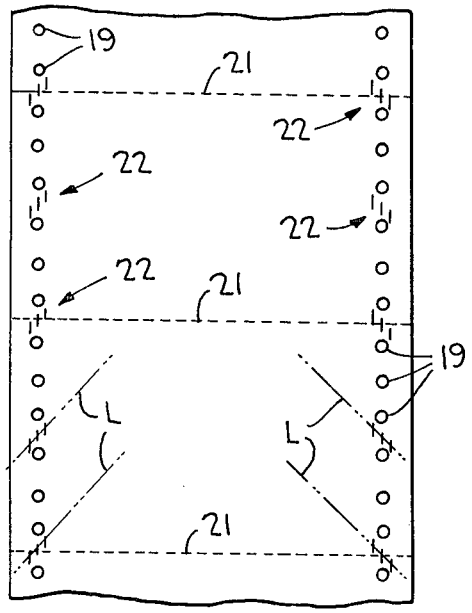
FIG. 1 is a top plan view of a continuous web assembly showing the spaced sets of interlocking tongues along opposite marginal edges, in accordance with the invention.

Turning now to the drawings wherein like reference characters refer to like and corresponding parts throughout the several views, a continuous web assembly is generally designated 10 and comprises a plurality of superimposed webs 11 to 14 interlocked together by means of interengaging locking tongues 15 to 18 respectively provided in the overlying webs.

Spaced feed holes 19 are provided along opposite marginal edges of the web assembly for engaging correspondingly spaced feed pins of typical tractor feed devices provided for feeding the web assembly in a direction of the arrow shown in FIG. 1 through a web processing machine. Of course, the feed holes may be provided along only one marginal edge for cooperation with a single feed device. And, each of the webs of assembly 10 is provided with superimposed transverse lines 21 of weakening for fan folding the assembly into a zigzag pack and for ultimately separating the assembly into individual units when burst along these transverse lines.

Sets generally designated 22 of locking tongues are equally spaced (see FIG. 1) along both marginal edges of the assembly and, for convenience, these sets may be located between adjacent feed holes as shown.

Figure 2:
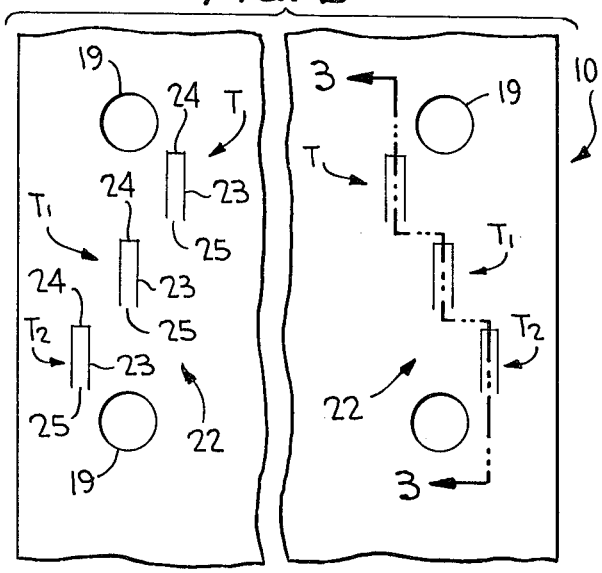
FIG. 2 is a view similar to FIG. 1 at an enlarged scale showing a part of the continuous web and the disposition of the interlocking webs of a pair of single sets in more detail.

The interengaging tongues of each set, as clearly shown in FIG. 2, are transversely spaced from one another and are staggered in the direction of feed to form an echelon arrangement of the three locking tongues of each set. (The showing of three tongues per set is only exemplary. Two or four tongues per set may otherwise be provided.) Hence, interlocking tongues generally designated T of each set lie forwardly in the direction of feed of the web assembly relative to adjacent interlocking tongues generally designated $T_1$, and tongues $T_1$ in turn lie forwardly of adjacent interlocking tongues generally designated $T_2$. These tongues of a typical set are graphically illustrated in FIG. 2 at opposite marginal edges of the assembly, and only the cuts forming the tongues are shown in the interest of clearly illustrating the particular disposition of tongues T, $T_1$ and $T_2$ of each set. Of course, the sets of tongues may be spaced along only one marginal edge of the assembly, if desired.

A punch device of some standard design may be used in forming each of the tongues by providing superimposed U-cuts 23 from a side of the assembly so as to define tongues 15 to 18 having free leading ends 24 and trailing ends 25 integral with their respective webs. As clearly shown, the tongues of each set lie along lines L disposed at angles to their adjacent marginal edges, with trailing ends 25 of tongues T lying laterally of leading ends 24 of tongues $T_1$. And, trailing ends 25 of tongues $T_1$ lie laterally of leading ends 24 of tongues $T_2$. It should be pointed out, however, that the adjacent tongues of each set may slightly overlap, or that the adjacent tongues of each set may be slightly spaced from one another in the direction of feed so as to form slight gaps therebetween.

Figure 3A:
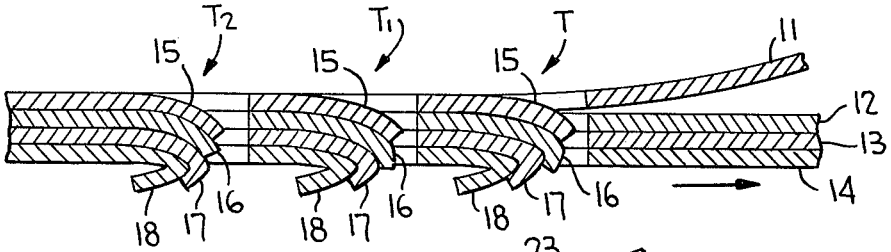
Figure 3B:
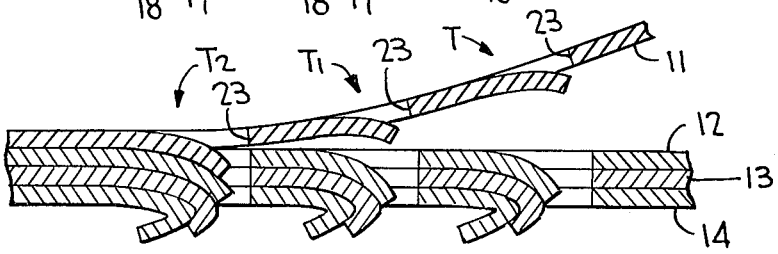
Figure 3C:
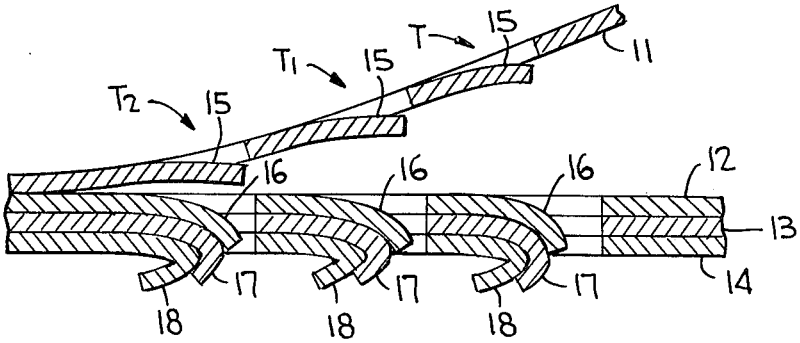

FIGS. 3*a*, 3*b* and 3*c* illustrate the sequential unlocking of the tongues at T, $T_1$ and $T_2$ upon decollating or the peeling apart of web 11 as the assembly is moved in the direction of feed during a decollating operation. A detailed description of this operation will follow hereinafter.

Before decollating, all the tongues 15 to 18 at each of T, $T_1$ and $T_2$ are respectively interengaged, as typically shown at $T_1$ and $T_2$ in FIG. 3*a*, as they are deflected outwardly of one side of the web assembly through cuts 23 so as to interengage as well as to engage in the adjacent apertures formed by the cuts so as to attach the webs relative to one another in the assembly. The particular formation of these tongues and the manner in which they serve to interlock superimposed webs together is by itself known in the art and is typically shown in U.S. Pat. No. 2,246,065.

The arrangement of tongues T, $T_1$ and $T_2$ of each set 22 of tongues as aforedescribed is likewise typical for a plurality of tongues fewer or more than the three per set 22 illustrated in the present drawings. Hence, if only two tongues T and $T_1$ per set are found necessary to releasably interlock superimposed webs together, they would be arranged along sloping lines L for each set. And, if four tongues per set are required for a given number of superimposed webs, they too would be arranged along sloping lines L for each set in an echelon fashion as shown in FIGS. 1 and 2. The number of tongues T provided for each set is determined by the holding power needed for interlocking a predetermined number of webs together in the assembly.

FIGS. 3*a*, 3*b* and 3*c* illustrate various stages of web separation during a web decollating operation. However, for the purpose of clarity only top web 11 is shown in the process of being separated or peeled apart from the remaining webs of the assembly. These remaining webs may be separated from one another at the time web 11 is separated, or they may be separated at some other stage of the decollating operation. Upon decollating either manually or with the use of a decollator of any well known type, adjacent webs are moved further apart as the assembly is moved in the direction of the arrow shown in FIG. 3*a*. A typical set 22 of tongues is shown in this Figure wherein tongues 15 of those shown at T near opposite marginal edges of the assembly disengage upon web separation while the remaining tongues $T_1$ and $T_2$ remain interengaged momentarily. Upon further web separation tongues 15 at $T_1$ are moved apart for disengagement as illustrated in FIGS. 3*b*; and, upon still further web separation tongues 15 at $T_2$ become separated as shown in FIG. 3*c*. It can be therefore seen that single tongues of each set encountered during web separation are disengaged at opposite marginal edges of the web assembly, with the remaining tongues in such sets disengaging sequentially upon web separation. The "snags" or "tugs" normally experienced during tongue disengagement for those transversely or laterally disposed tongues in each set as in the prior art are avoided with the present invention since tongues T disengage before tongues $T_1$ which disengage before tongues $T_2$ thereby each offering a disengaging resistance equal only to that of a single tongue during decollation. However, the holding power created by the use of several tongues arranged in the form of an echelon is comparable to a like number of tongues arranged transversely of the web. A simple and smooth decollating operation is thereby assured with the present arrangement.

Figure 4:
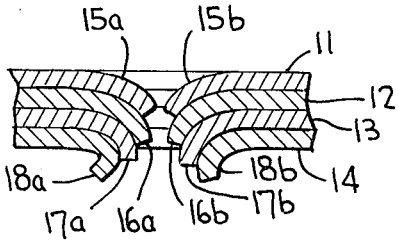
FIG. 4 is a sectional view similar to FIG. 3 showing tongues formed by different cuts provided in the web assembly.

An alternative form of tongue formation is shown in FIG. 4 wherein tongues 15*a* to 18*a* and 15*b* to 18*b* are formed by substantially H-shaped cuts made at one side of the assembly by a suitable punch device.

Obviously, many modifications and variations of the present invention are made possible in the light of the above teachings. It is therefore to be understood that within the scope of the appended claims, the invention may be practiced otherwise than as specifically described.

What is claimed is:

1. In an assembly of continuous webs including at least a pair of superimposed continuous webs having spaced feed holes along at least one marginal edge thereof, longitudinally spaced transverse superimposed lines of weakening in said webs for fan folding the assembly into a zig-zag pack and for separating the assembly into individual units when burst therealong, means comprising sets of interlocking tongues spaced longitudinally along at least said one marginal edge for solely interlocking said webs together, said sets each comprising first superimposed interengaging tongues in said webs and second superimposed interengaging tongues in said webs spaced transversely from and adjacent said first tongues, said tongues being formed by cuts having legs parallel to said marginal edge, said tongues extending in a forward direction of feed of the assembly through a web processing machine having free ends and having opposite ends integral with their respective webs, said sets of tongues being longitudinally spaced apart a first predetermined distance from one another, and said first and second tongues in each said set being transversely spaced apart a second predetermined distance less than said first distance, the improvement comprising, said first tongues and second tongues of each said set being longitudinally spaced apart a third predetermined distance less than said first distance, said free ends of one of said tongues in each said set being disposed forwardly of the other of said tongues in each said set in the direction of feed, whereby said one of said tongues in a first of said sets relative to the direction of feed commences disengaging before said other of said tongues in said first set upon separation of said webs in the direction of feed, and said one of said tongues in a second of said set relative to the direction of feed commences disengaging before said other of said tongues in said second set upon further separation of said webs, and so on for the remaining sets upon still further separation of said webs, whereby simultaneous disengagement of said tongues in said first set, in said second set and in said remaining sets is avoided to thereby decrease resistance offered by said tongues upon web separation.

2. In the assembly according to claim 1, wherein each said set further comprises third superimposed interengaging tongues in said webs spaced transversely from and adjacent said second tongues, said second and third tongues in each said set being transversely spaced apart said second predetermined distance and being longitudinally spaced apart said third predetermined distance, said free ends of said other of said tongues in each said set thereby being disposed forwardly of the remaining of said tongues in each said set in the direction of feed, whereby said remaining tongues in said first set commences disengaging after said other of said tongues in said first set upon said separation of said webs, and said remaining tongues in said second set commences disengaging after said other of said tongues in said second set upon said further separation of said webs.

* * * * *